US005118928A

United States Patent [19]

Ohike et al.

[11] Patent Number: 5,118,928

[45] Date of Patent: Jun. 2, 1992

[54] EXTERNAL PINION TYPE ODOMETER

[75] Inventors: Yukio Ohike; Tomohiro Sugiyama, both of Shizuoka, Japan

[73] Assignee: Yazaki Corporation, Tokyo, Japan

[21] Appl. No.: 704,742

[22] Filed: May 23, 1991

[30] Foreign Application Priority Data

May 24, 1990 [JP] Japan ..... 2-53563[U]

[51] Int. Cl.[5] ..... G06C 9/00

[52] U.S. Cl. ..... 235/133 R; 235/139 R

[58] Field of Search ..... 235/133 R, 139 R, 95 R, 235/96

[56] References Cited

U.S. PATENT DOCUMENTS 1,506,939 9/1924 Pankonin ..... 235/139 R 3,202,353 8/1965 Nowak et al. ..... 235/95 R

FOREIGN PATENT DOCUMENTS 44-21129 9/1969 Japan .

*Primary Examiner*—L. T. Hix

*Assistant Examiner*—Eddie C. Lee

*Attorney, Agent, or Firm*—Sughrue, Mion, Zinn, Macpeak & Seas

[57] ABSTRACT

An external pinion type odometer, in which the outer diameter of at least a lower digit wheel, a surface portion of which has numbers stamped, is made smaller than the outer diameter of the lower digit wheel, another surface portion of which slidingly contacts with a wide tooth of the corresponding transfer pinion. The stamped numbers do not contact with the wide teeth of the transfer pinion, thereby excluding the likelihood that the stamped numbers will come to peel off.

5 Claims, 2 Drawing Sheets

EXTERNAL PINION TYPE ODOMETER

BACKGROUND OF THE INVENTION

The invention relates to external pinion type odometers, and more particularly to an external pinion type odometer in which digit wheels are arranged close to one another.

Conventionally, external pinion type odometers of this type are used as, e.g., an odometer attached to a vehicle to measure the distance traversed or as being incorporated into a combination meter together with other types of measuring instruments for the vehicle.

Vehicles, with recent improvements in their performance, can run for more than 100,000 km. Under such circumstances, an odometer capable of indicating the travelling distance in 6 digits is under study in order to replace the 5-digit indication system of a conventional odometer whose maximum count of distance is generally 99,999 km. If the number of digits is increased using the conventional construction, the space to indicate the travelling distance must be increased or a like problem must be handled, and these problems are taken care of by arranging the digit wheels close to one another.

FIG. 3 is a plan view showing an exemplary conventional odometer in which its digit wheels are short-distanced from one another. In FIG. 3, a rotating shaft 2, whose ends are firmly fixed to two confronting supporting plates 1*a*, 1*b* of a frame 1, rotatably supports a group of digit wheels 3, the group allowing indications in 6 digits. Each of the digit wheels 3 has numbers 3', 1 through 0, stamped equidistantly all around its surface 3*a* by, e.g., hot stamping or printing. Further, as shown by a partially enlarged view in FIG. 4, each lower digit wheel 3 has a recess 3*b* formed on its left edge so that the recess 3*b* extends beyond the stamping width of a recessed number 3', whereby two drive gears 3*b'* are formed integrally with the corresponding digit wheel 3. Each upper digit wheel 3 has on its right side a driven gear 3*c* consisting of twenty (20) teeth, the driven gear being formed integrally with the corresponding digit wheel 3.

Reference numeral 4 designates a drive wheel having no character stamped on its surface and only two drive gears (not shown) are formed on its left side. The drive wheel 4 is driven by a not shown means in accordance with the driving of a vehicle.

A rotating shaft 5, whose ends are secured to two confronting standing strips 1*c*, 1*d* of the frame 1 and which is juxtaposed with respect to the rotating shaft 2, rotatably supports six (6) transfer pinions 6. The six transfer pinions 6 are arranged so that each alternates with one of seven wheels consisting of the digit wheels 3 and the drive wheel 4. As shown in FIGS. 5 and 6, each transfer pinion 6 has an array of eight (8) teeth. The array consists of four wide teeth 6*a* and four narrow teeth 6*b*, and each wide tooth alternates with each narrow tooth, all being flush with one reference side. It is so arranged that a narrow tooth 6*b* of the transfer pinion 6 is meshed with the driven gear 3*c* of each upper digit wheel 3 at all times, and that a wide tooth 6*a* is brought into engagement with the drive gears 3*b'* upon being inserted into the recess 3*b* as a result of each lower digit wheel 3 having made one full rotation and reached a predetermined rotating position. Accordingly, as the two drive gears 3*b'* have engaged with the wide tooth 6*a* of the transfer pinion 6 by one full rotation of the lower digit wheel 3 and the transfer pinion 6 thereby makes a quarter rotation, the narrow tooth 6*b* makes a rotating movement corresponding to two teeth. As a result, the corresponding upper digit wheel 3 having the driven gear 3*c* that is in engagement with the narrow tooth 6*b* at all times makes a 1/10 rotation, setting a next number to a next indicating position.

As described above, to indicate a greater number of digits with the conventional odometer, a limited space is utilized in such a manner that the digit wheels 3 are distanced close to one another by forming the two drive gears 3*b'* integrally with each digit wheel 3 while arranging on the left side of the digit wheel 3 the recess 3*b* so that the recess 3*b* extends beyond the stamping width of the recessed number 3'. For this reason, when a digit wheel 3 is rotating without engagement of a wide tooth 6*a* of the corresponding transfer pinion 6 with the drive gears 3*b'*, the surface 3*a* of the digit wheel 3 is rubbed by the wide tooth 6*a* of the transfer pinion 6 as shown in FIG. 4. This also causes the number 3' portion, which is indicated by shading in FIG. 4, to be rubbed by the wide tooth 6*a*, and, as a result, the stamped portions of the lower digit wheels which rotate more frequently than the upper digit wheels come to peel off.

The invention has been made in view of the above circumstances. Accordingly, an object of the invention is to provide an external pinion type odometer in which the stamped numbers do not peel off even if the recess to be engaged with a wide tooth of the transfer pinion extends beyond the stamping width of a number so that the digit wheels can be arranged close to one another.

SUMMARY OF THE INVENTION

To achieve the object, the invention is applied to an external pinion type odometer which includes a plurality of digit wheels, each of which has numbers, 1 through 0, stamped equidistantly on its surface. These digit wheels are rotatably supported by a first rotating shaft whose ends are firmly fixed. Each lower digit wheel has a recess formed on its left edge so that the recess extends beyond the stamping width of a recessed number, whereby two drive gears are formed integrally with the corresponding digit wheel. Each upper digit wheel has a driven gear around its right side surface. Transfer pinions, each of which has wide teeth and narrow teeth arranged alternately, are rotatably supported by a second rotating shaft whose ends are firmly fixed and which is juxtaposed with respect to the first rotating shaft. A narrow tooth of the transfer pinion is meshed with the driven gear of each upper digit wheel at all times, and a wide tooth is brought into engagement with the drive gears upon its being inserted into the recess as a result of each lower digit wheel having made one full rotation and reached a predetermined rotating position. Accordingly, the rotation of the lower digit wheel is transferred intermittently to the corresponding upper digit wheel through the transfer pinion to take a digit up one place. In such an external pinion type odometer, the outer diameter of at least one lower digit wheel, a surface portion of which has the numbers stamped, is made smaller than the outer diameter of such lower digit wheel, a surface portion of which rides on the wide teeth of the corresponding transfer pinion.

In the above construction, the outer diameter of a digit wheel, a surface portion of which has the numbers stamped is made smaller than the outer diameter of the digit wheel, a surface portion of which slidingly contacts with the wide teeth of the corresponding transfer pinion. Therefore, even if the recess to be meshed with the wide teeth of the transfer pinion is formed so as to extend beyond the stamping width of each number, the numbers stamped on the surface portion of the digit wheel are no longer moved by the rotation of the digit wheel while rubbing the wide teeth of the transfer pinion.

DETAILED DESCRIPTION OF THE PREFERRED EMBODIMENT

An embodiment of the invention will be described with the accompanying drawings.

Figure 1:
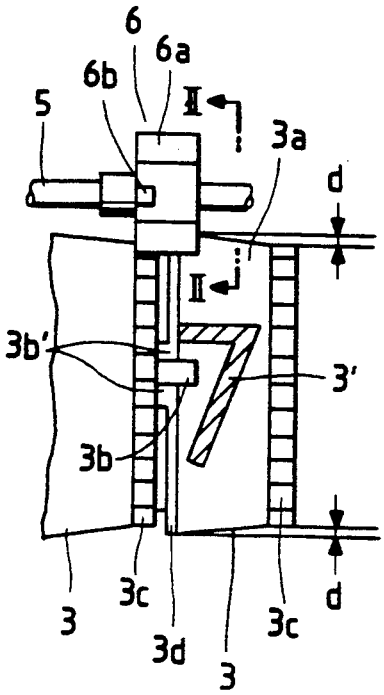
FIG. 1 is a diagram showing an external pinion type odometer, which is an embodiment of the invention.
Figure 4:
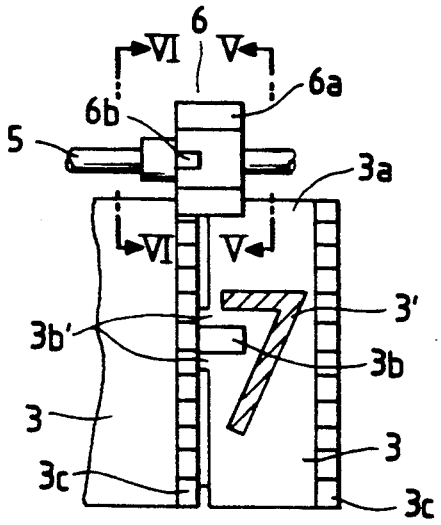
PRIOR ART FIG. 4
FIG. 4 is an enlarged view showing a portion of the odometer shown in FIG. 3.
Figure 5:
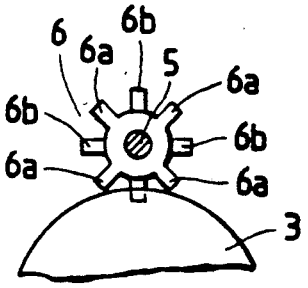
PRIOR ART FIG. 5
FIG. 5 is a sectional view taken along a line V—V shown in FIG. 4.
Figure 6:
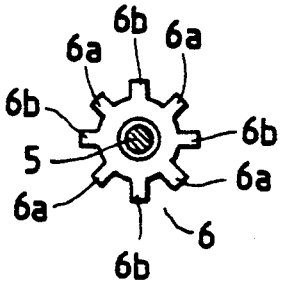
PRIOR ART FIG. 6
FIG. 6 is a sectional view taken along a line VI—VI shown in FIG. 4.

FIG. 1 shows an external pinion type odometer, which is an embodiment of the invention. In FIG. 1, parts and components which are equivalent to those of the conventional example shown in FIGS. 4 and 5 are designated by same reference numerals.

Figure 2:
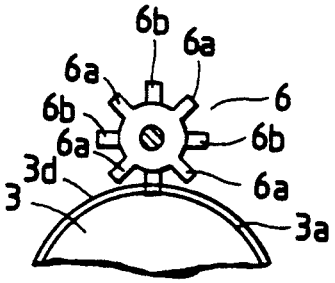
FIG. 2 is a sectional view taken along a line II—II shown in FIG. 1.
Figure 3:
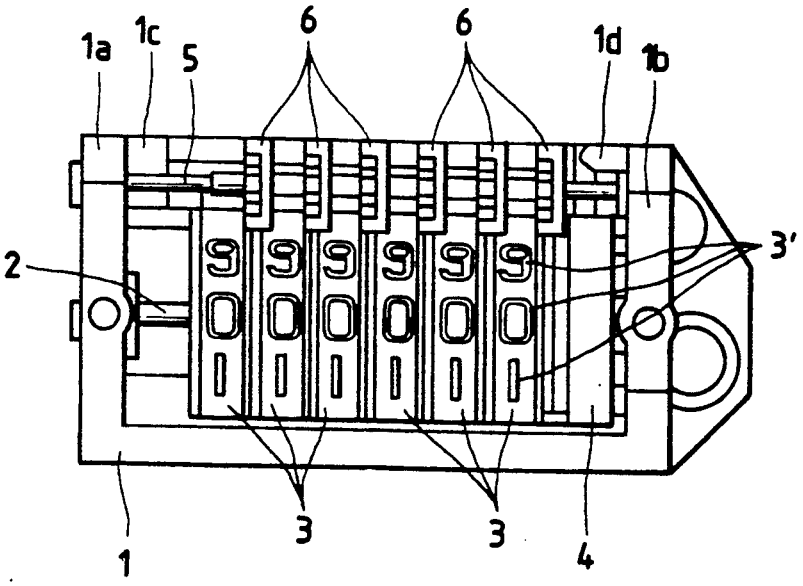
PRIOR ART FIG. 3
FIG. 3 is a plan view showing a general construction of a conventional ordinary external pinion type odometer.

Referring to FIG. 1, a surface 3*a* of a digit wheel 3, on which a number 3' has been stamped, is tapered so that the outer diameter of the digit wheel 3 becomes smaller by a scanty amount d from the left side end of the stamping width of the number 3' toward the right side thereof. The scanty amount d is such as not to hamper the engagement between a driven gear 3*c* whose outer diameter is made smaller with a taper and a narrow tooth 6*b* of a transfer pinion 6. By tapering the surface 3*a* of each digit wheel 3 as described above, a plain circular surface 3*d* having the largest outer diameter is formed at the left side of the stamping width, and on this plain circular surface 3*d* is a wide tooth 6*a* of the transfer pinion 6 carried as shown in FIG. 2.

In the above construction, the outer diameter of the plain circular surface 3*d* of the digit wheel 3 is larger than that of a surface on which a number 3*a* is stamped. Therefore, the wide tooth 6*a* of the transfer pinion 6 does not rub the upper surface on which the number 3' is stamped even if a recess 3*b* with which the wide tooth 6*a* of the transfer pinion 6 is meshed is formed so as to jut out into the stamping width. As a result, there is no likelihood that the stamped portions will be deleted by the rubbing.

To stamp a number 3' on the tapered surface 3*a*, a portion of the number to be stamped on the smaller diameter must preferably be slightly enlarged compared with a number to be stamped on a plain circular surface, so that the stamped number can be visibly identified as being undeformed.

In the embodiment shown in FIG. 1, the recess 3*b* for forming two drive gears 3*b*, is positioned at a number, "7". This is because the number "7" has a profile suitable for causing the recess 3*b* to extend far beyond into the stamping width compared with other numbers, thereby being most effective in arranging neighboring digit wheels close to one another. However, even if the recess 3*b* is arranged so as to correspond to some other number 3', the invention can be applied equally as long as each wide tooth 6*a* of the transfer pinion 6 overlaps the stamping width and the recess 3*b* is formed so as to extend beyond the stamping width.

While no specification as to which digit wheel 3 is tapered is made in the above description, at least a lower digit wheel 3 which is subjected to frequent rotation is tapered, so that the problem that its stamped portions come to peel off can be overcome. However, to share the digit wheels 3 in common, all the digit wheels may be tapered.

As described in the foregoing, according to the invention, the outer diameter of at least a frequently rotated lower digit wheel, a surface portion of which has the numbers stamped is made smaller than the outer diameter of the lower digit wheel, a surface portion of which rides on the wide teeth of the transfer pinion. Therefore, even if the recess to be meshed with the wide teeth of the transfer pinion is formed so as to extend beyond the stamping width of each number, such numbers stamped on the surface portion of the digit wheel are no longer rubbed by the wide teeth of the transfer pinion, thereby excluding the likelihood that the numbers stamped on the surface of the digit wheel will come to peel off.

What is claimed is:

1. An external pinion type odometer comprising:

a plurality of digit wheels, each of said digit wheels having numbers, 1 through 0, formed equidistantly on a surface thereof and being rotatably supported by a first shaft wherein each lower digit wheel has a recess formed on a first edge thereof so that two drive gears are arranged integrally with said lower digit wheel, said recess extending beyond a physical width of said numbers, while each upper digit wheel has a driven gear formed around a first side surface thereof; and said odometer further comprising:

transfer pinions, each of said transfer pinions having an array of wide teeth and narrow teeth and being rotatably supported by a second shaft which is juxtaposed to said first shaft, each of said wide teeth alternating with each of said narrow teeth, wherein one of said narrow teeth on said transfer pinion is normally meshed with said driven gear of each upper digit wheel, and when each lower digit wheel has made one full rotation and reached a predetermined rotating position, one of said wide teeth is inserted into said recess and thus engaged with said drive gears, whereby the rotation of each lower digit wheel is transferred intermittently to each corresponding upper digit wheel through said transfer pinion to take a digit up one place;

wherein an outer diameter of a first portion of at least one lower digit wheel, a surface portion of which has said numbers, is made smaller than an outer diameter of a second portion of said one lower digit wheel, a surface portion of which rides on said wide teeth of the corresponding transfer pinion, wherein said outer diameter of said one lower digit wheel is tapered from said second portion to said first portion.

2. The odometer according to claim 1, wherein said second portion is a plain circular portion.

3. The odometer according to claim 2, wherein said second portion slidingly contacts with the associated transfer pinion.

4. The odometer according to claim 1, wherein said numbers are printed on said digit wheels.

5. The odometer according to claim 1, wherein said numbers are hot stamped on said digit wheels.

* * * * *